US005381995A

United States Patent [19]

Del Zotto

[11] Patent Number: 5,381,995

[45] Date of Patent: Jan. 17, 1995

[54] CONCRETE HOLE FORMER

[76] Inventor: William M. Del Zotto, 2300 Commonwealth Ave., Duluth, Minn. 55808-1699

[21] Appl. No.: 43,301

[22] Filed: Apr. 6, 1993

[51] Int. Cl.[6] ..... B28B 7/30

[52] U.S. Cl. ..... 249/35; 249/142; 249/151; 249/152; 249/178; 249/183

[58] Field of Search ..... 249/142, 144, 146, 150, 249/152, 153, 178, 179, 183, 184, 186, 35, 151

[56] References Cited

U.S. PATENT DOCUMENTS

| | | | |
|---|---|---|---|
| 92,108 | 6/1869 | Shickle | 249/183 |
| 150,333 | 4/1874 | Leverty | 249/183 |
| 1,053,420 | 2/1913 | McDaniel | 249/193 |
| 1,101,204 | 6/1914 | Massey | 249/193 |
| 1,311,282 | 7/1919 | McKay | 249/193 |
| 1,397,649 | 11/1921 | Mitchell | 249/179 |
| 3,656,732 | 4/1972 | St. John | 249/179 |
| 3,734,450 | 5/1973 | Lengel | 249/145 |
| 3,815,864 | 6/1974 | Loeber | 249/183 |
| 4,192,704 | 3/1980 | Stange | 249/179 |
| 4,625,976 | 12/1986 | Gilbert | 249/145 |
| 4,643,387 | 2/1987 | Bo | 249/193 |
| 4,650,149 | 3/1987 | Poulette et al. | 249/145 |
| 5,169,544 | 12/1992 | Stanfill et al. | 249/35 |
| 5,171,507 | 12/1992 | Del Zotto | 264/219 |

FOREIGN PATENT DOCUMENTS

| | | | |
|---|---|---|---|
| 22226 | 10/1916 | Denmark | 249/179 |
| 2319190 | 10/1974 | Germany | 249/35 |
| 13055 | of 1913 | United Kingdom | 249/179 |
| 263489 | 8/1927 | United Kingdom | 249/179 |

*Primary Examiner*—Khanh Nguyen
*Attorney, Agent, or Firm*—Douglas L. Tschida

[57] ABSTRACT

A compressible band and end retainer assembly which secures opposite ends of a band to an intermediate spacer. The band mounts between facing concrete sidewall forms to define a hole, upon pouring and curing a slurry of surrounding concrete. Various band geometries permit hole formation in planar or curvilinear poured walls.

12 Claims, 7 Drawing Sheets

CONCRETE HOLE FORMER

BACKGROUND OF THE INVENTION

The present invention relates to apparatus for forming holes in poured concrete walls and, in particular, to a discontinuous band assembly which mounts between opposite, facing form walls to define a void or through hole in the poured walls of the formed concrete.

The formation of holes in poured concrete structures can be achieved with a variety of available molding or forming dies or mandrels. These dies can range from rudimentary to complex assemblies.

The size and shape of a desired aperture can affect the pouring process and the ability of a fabricator to cost effectively form a desired number of holes of desired sizes and shapes. That is, where multiple holes are required at sizes in excess of twelve inches, it frequently becomes necessary to use commercially available forming die sets which are rather costly to obtain and inventory for most fabricators. Correspondingly, one die set is required for each desired hole. For many monolithically cast structures, a large number of die sets can be required. The casting forms must also be compatible with the hole forming dies; thus the cost to pour a desired structure is affected by forms availability.

For small production runs or small hole sizes, rudimentary dies may consist of a solid or hollow object having a shape corresponding to the desired hole, such as a length of pipe or a solid pre-formed plug which is capable of being mounted between the walls of the casting mold. While a variety of plugs exist for planar wall structures, curvilinear walls present many difficulties that are not readily overcome without the benefit of specially prepare assemblies.

Various assemblies for forming relatively small diameter gasketed holes in poured concrete structures can be found upon referencing to U.S. Pat. Nos. 3,727,876; 3,832,438; 4,625,976; 4,805,920; 4,842,785; and 4,951,914. The hole forming assemblies of the foregoing references each generally provide mandrels which are supported to the casting form walls with through fasteners that bolt to the form walls.

Each form supports an elastomer gasket which is cast in place at the structure wall. The forms are constructed as unitary or multi-part assemblies. The latter assemblies, which are disclosed at the 4,842,785; 3,832,438; 3,727,876; and 4,625,976 patents, provide fixed diameter annular assemblies which are compressively drawn into engagement with each other and the gasket. The gasket is thus pinched to the casting form.

U.S. Pat. No. 5,171,507 discloses another fixed sized casting mandrel which is manufactured by Del Zotto Manufacturing, Inc., the assignee of the subject invention.

U.S. Pat. No. 4,801,417 discloses a manhole casting form which supports multi-section hole formers from holes cut into a wire meshwork, prior to forming. Although the hole former molds are distinguishable from the present assemblies, an inner wall form of the manhole casting mold assembly provides a large diameter band having mating edges which are restrained together via a hinge assembly. The hinge assembly permits relaxation of and expansion of the form after the form is stripped from the cast structure. In contrast to the present invention, the form expands outward. Preferably, the form should collapse inward to facilitate release from the cast structure.

In appreciation of the foregoing deficiencies, the present invention provides a variety of hole former assemblies. The assemblies are readily constructed from flat metal stock and can be formed to accommodate planar or curvilinear pouring forms. The assemblies are constructed to be passively retained between assembled, molding forms. The walls of each assembly collapse inward to facilitate release from a poured structure.

SUMMARY OF THE INVENTION

It is accordingly a primary object of the invention to provide a hole former assembly which readily mounts between facing walls of planar or curvilinear casting forms.

It is a further object of the invention to provide an assembly which can be constructed from flat stock materials that can be configured or cut to form a band of a desired contour shape.

It is a further object of the invention to provide a retention assembly for securing the ends of a contoured band in an expanded condition during pouring.

It is a further object of the invention to provide a band retention assembly which can be released and compressed subsequent to curing of the concrete slurry to allow release of the band from the cast structure.

It is a further object of the invention to provide a resilient hole defining band, a mating end spacer which partially defines the hole contour and a band and a spacer retainer assembly, and all of which cooperate to permit release of the hole former upon the curing of the concrete.

Various of the foregoing objects, advantages and distinctions of the invention are particularly achieved in a number of presently preferred constructions which are described more fully below. In each construction, a discontinuous band is cut to a desired contour from a section of flat metal stock. The ends of the band are shaped to receive an intermediate spacer block. A retention assembly secures the spacer block between the band ends and during the pouring of a concrete slurry. A surface of the spacer aligns with a molding surface of the band. Each band is passively supported between facing casting walls with a provided reinforcing mesh or pins which are inserted through the form sidewalls. Active supports may also be used to secure the hole former to the mold or form walls.

Depending upon the desired hole shape, the band is cut to exhibit a corresponding contour shape upon assembly with opposite facing walls of the casting form. Opposite ends of the band include tangs which mate with a cooperating spacer. A tether restrains the spacer to the band. A clamp retains the tangs and spacer to one another during cure. Once cured and with the release of the clamp and spacer, the band can be compressed to release the hole former assembly from the cured aperture.

Various considered hole former assemblies are disclosed which are usable with flat wall or contour wall cast structures. Couplers are provided at surface wall transitions to hinge the band segments to one another.

Various alternative spacer and retainer assemblies are also disclosed. In one retainer assembly, retention pins and mating clip fasteners secure the spacer and band together. In another retainer assembly, slots or channels are provided at the spacer for receiving the tanged ends of the band.

Still other objects, advantages and distinctions of the invention are described in the following description with respect to the appended drawings. To the extent various modifications or improvements have been considered, they are described as appropriate. The scope of the invention should not be narrowly construed to description, but rather to the also appended claims.

DESCRIPTION OF THE PREFERRED EMBODIMENT

Figure 1:
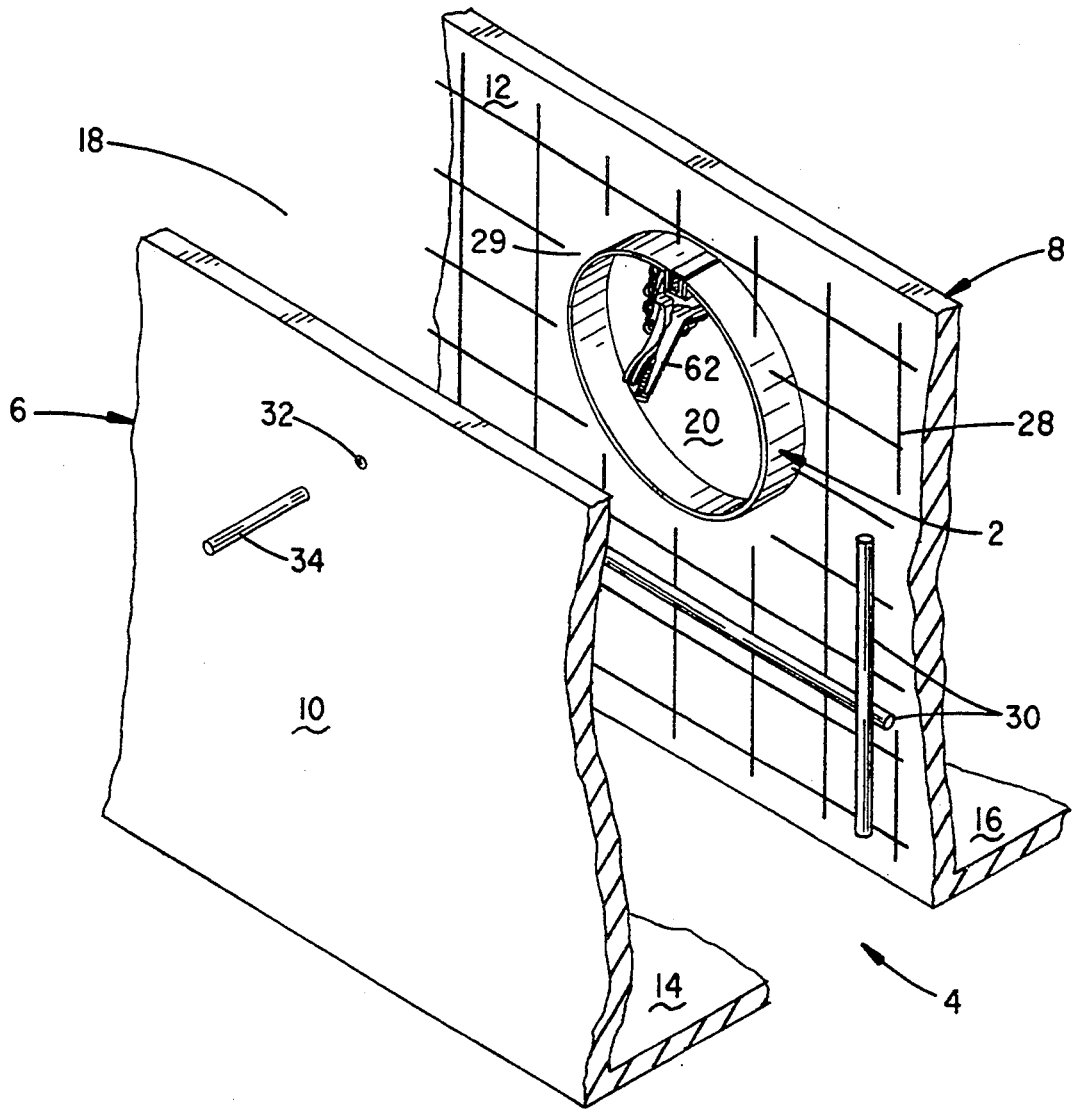
FIG. 1 is a perspective drawing of one hole former assembly of the invention depicted in relation to a pair of opposite facing sidewall forms.

Referring to FIG. 1, a perspective drawing is shown of the inventive hole forming or mold core assembly 2 in a typical application. The assembly 2 is used to form holes or contoured apertures in the walls of poured concrete structures, such as septic tanks, junction boxes, manholes and a variety of other pre-cast or poured-in-place structures.

The assembly 2 is shown in a typical mounted condition relative to a cutaway section of a multi-section, multi-walled planar casting assembly 4. The assembly 4 includes an external mold 6 and an internal core mold 8. The assembly 4 might be used to form pre-cast septic tanks, storage tank housings or junction boxes, among other structures. The external mold 6 and internal core mold 8 include respective side and bottom wall form pieces 10, 12 and 14, 16. Together with side wall form pieces (not shown), the molds 6 and 8 define a cavity space 18 between the molding forms 6 and 8, where a concrete slurry is poured.

The slurry is directed by casting operators to uniformly fill the assembly 4 and to flow about all intervening structures, such as the hole former assembly 2. Once cured, the poured concrete structure exhibits the shape defined by the casting assembly 4, along with appropriately sized and positioned holes 20. The holes 20 may extend completely or partially through the cast wall. Any partially cast holes or "knockouts" may later be cleared as necessary.

Figure 6:
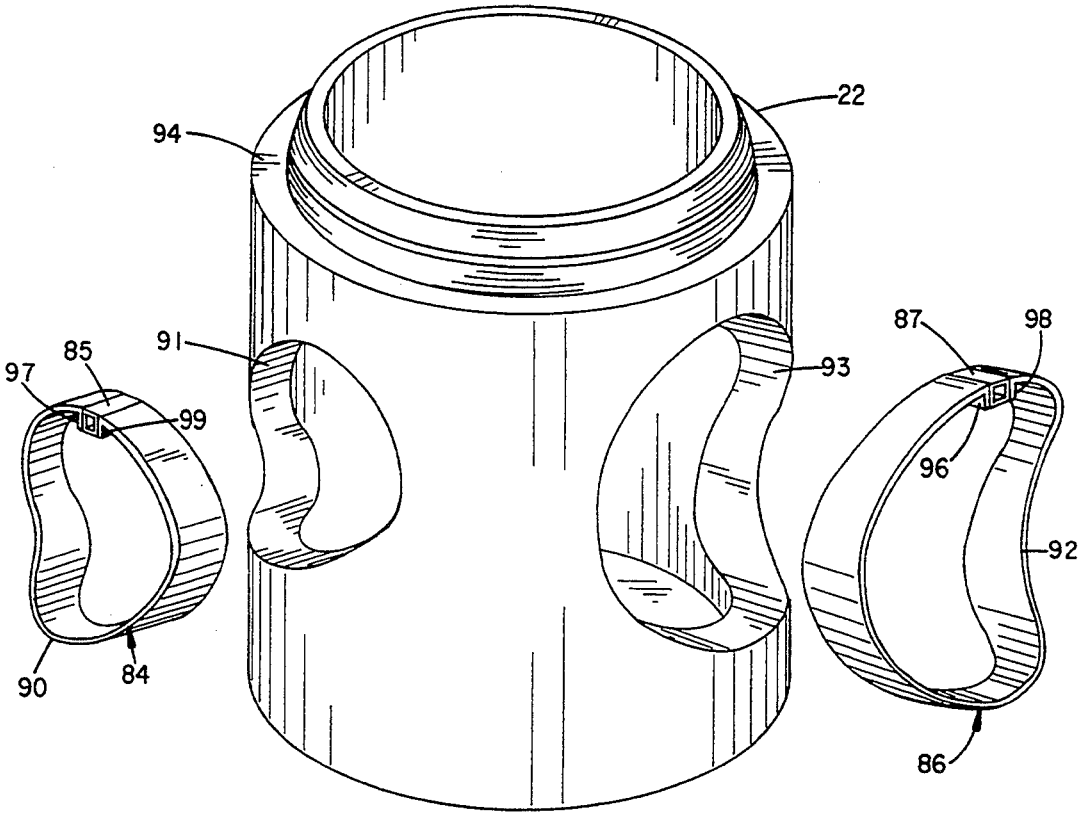
FIG. 6 is an exploded assembly drawing of a cured manhole and a pair of contoured hole formers.
Figure 7:
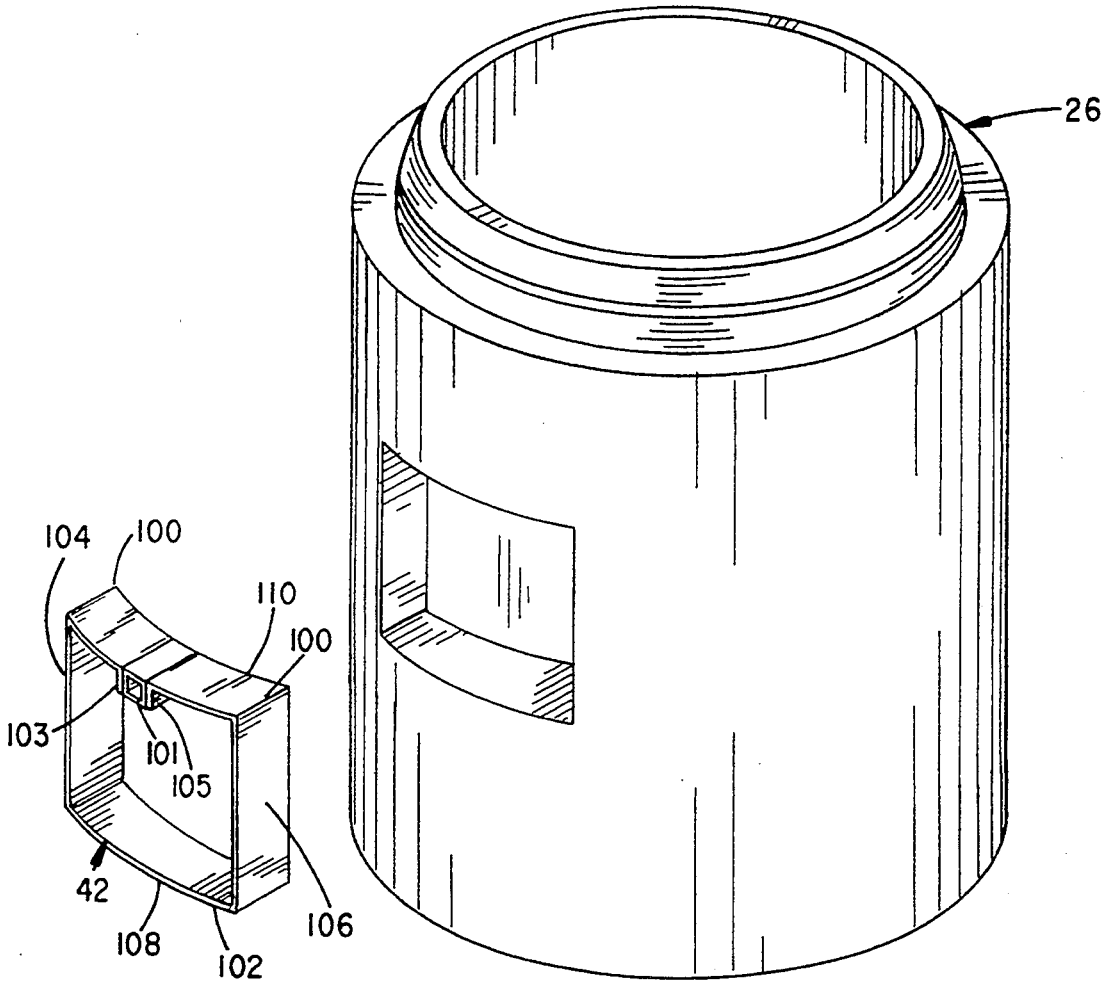
FIG. 7 is an exploded assembly drawing of a square hole former removed from a cast manhole.

The holes 20 are commonly required to accommodate sealed, inlet and outlet conduits (not shown) which mate with the cast structure. In the instance of a septic tank, such conduits direct waste liquids into and out of the tank. For manhole structures 22 and 26, such as depicted at FIGS. 6 and 7, larger liquid flow volumes are directed in relation to public sewage systems.

When forming the cast concrete structure, a wire formed meshwork 28 is typically mounted in the cavity space 18 between the molding forms 6, 8. Lengths of steel re-bar 30 can be added as needed with the mesh 28 to reinforce the cast structure. The re-bar pieces 30 are typically wired to the mesh 28 or alternatively may be constructed as a stand alone structure which is mounted within the cavity space 18.

Depending upon the numbers and locations of desired apertures 20 in the poured structure, once the meshwork 28 is mounted, holes 29 are cut into the wire at desired locations. Separate hole former assemblies 2 are inserted into the holes 29 and supported by the cut ends of the meshwork 28. The meshwork 28 typically provides sufficient support for the relatively light weight hole former assemblies 2 to retain each assembly 2 in place as the outer casting mold 6 is positioned and the walls 10 and 12 are brought into abutment with the hole former 2.

For repetitive casting operations and structures having defined hole locations, a number of suitably positioned apertures 32 can be provided in the molding forms 6 or 8 to receive one or more pin supports 34. The supports 34 project into the cavity space 18 to support the hole former 2 in relation to the casting forms 6, 8. Such pins 34 find advantage for heavier weight hole formers 2, such as used with larger diameter and thicker cavity wall structures, for example the manholes 22, 26 of FIGS. 6 and 7. The band 40 can merely rest on the pins 34 or the pins 34 may mount in tubular sleeves (not shown) secured to the interior walls of the former assembly 2.

Typical hole sizes which can be accommodated with the present hole forming assemblies 2 range from hole diameters of 12 to 54 inches and wall thicknesses from 3 to 12 inches. Custom sized formers of larger diameter and/or greater wall thicknesses or non-circular, contoured hole shapes can be formed as desired. The manner of constructing the hole formers 2 is described in greater detail below.

Figure 2:
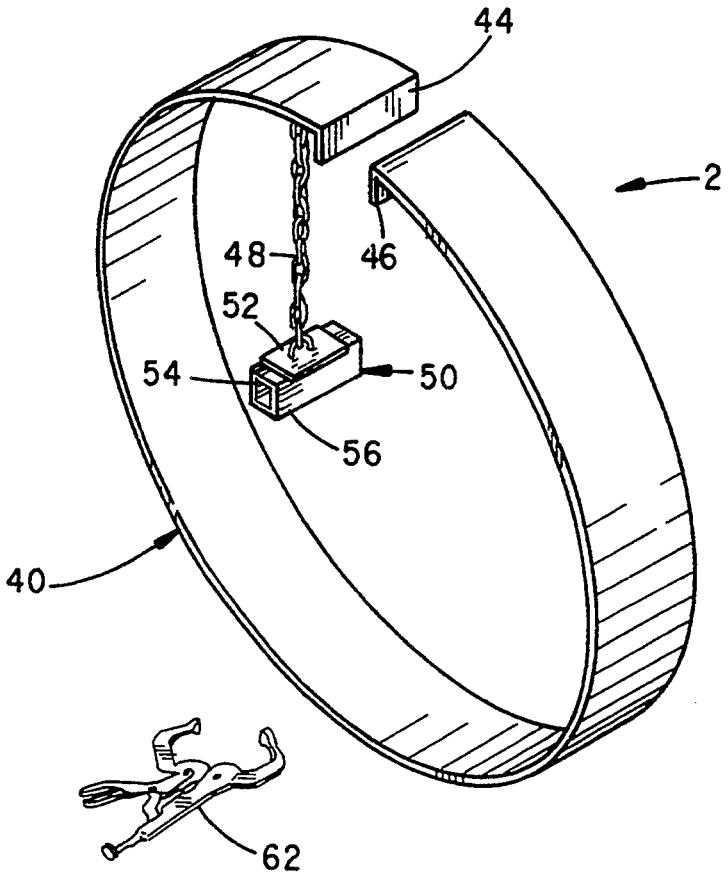
FIG. 2 is a perspective drawing of the hole former of FIG. 1 in an uncompressed condition.
Figure 3:
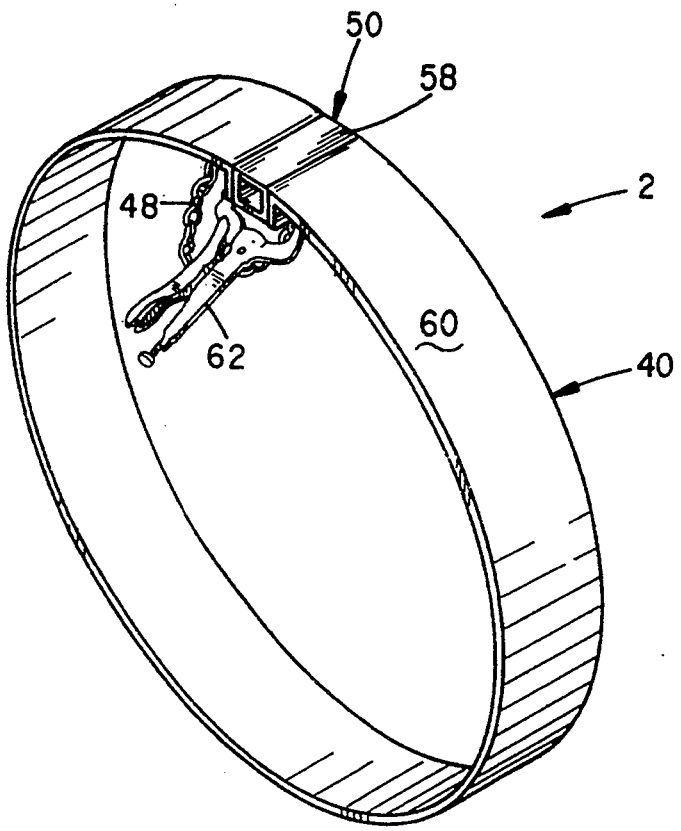
FIG. 3 is a perspective drawing of the hole former of FIG. 1 in a compressed condition.

Referring to FIGS. 2 and 3, more of the details are shown of the hole former assembly 2 of FIG. 1. The assembly 2 generally comprises a band 40 of a durable flat stock material, such as a metal or plastic, which is formed to exhibit a preferred aperture geometry or contour. Typically and for a circular hole 20, a 3/16 or ¼ inch thick piece of steel sheet stock is cut to a desired geometry and roll formed. Alternatively, bends can be formed into the band to accommodate square or rectangular holes, such as for the hole former 42 at FIG. 7. Offset tangs 44, 46 are welded or formed into the extreme ends of the band 40. A short tether chain 48 is secured to an inner surface of the band 40 and to which a spacer or clip 50 is secured.

The spacer 50 is constructed of a length of square or rectangular tube stock which is cut to a length corresponding to the thickness of the cavity space 18. The spacer 50 is alignable with the tangs 44, 46 to prevent any voids in the poured walls at the hole 20, reference FIG. 3. Secured along the bottom of the spacer is a plate 52 which receives the tether 48. The plate 52 projects from the opposite vertical sides 54, 56 of the spacer 50 to define tang stop surfaces 57, reference FIG. 4, which align the spacer 50 in relation to the tangs 44, 46. The exposed, top surface 58 of the spacer 50 thereby aligns with the exposed surface 60 of the band 40.

As depicted at FIG. 3, the spacer 50 is normally inserted between the tangs 44, 46, which tend to flare apart due to the properties of rolled band material. A VICEGRIPS pliers 62 is provided to draw the tangs 44, 46 into abutment with the spacer 50 and retain the hole former 2 in the closed condition during a pour operation, reference FIG. 1.

Upon stripping the casting molds 6 and 8 away from the cured or partially cured structure, the pliers 62 is released and the spacer 50 removed. The tangs 44, 46 are then flexed inward toward each other to release the band 40 from the cured structure. As necessary, the band 40 can be pried from the walls of the hole 20. In contrast to prior fixed diameter, hole formers, it is oftentimes necessary to drive the opposite plate from the cast hole, which efforts over time reduce the useful life of the hole former.

Although a pliers clamping assembly is disclosed, it is to be appreciated a variety of other retainer assemblies can be employed with equal advantage with the spacer 50 to compress and retain the tangs 44, 46 to the spacer 50. For example, threaded bolts, pin fasteners, C-clamps and a variety of other readily available assemblies can be used to this end.

Figure 4:
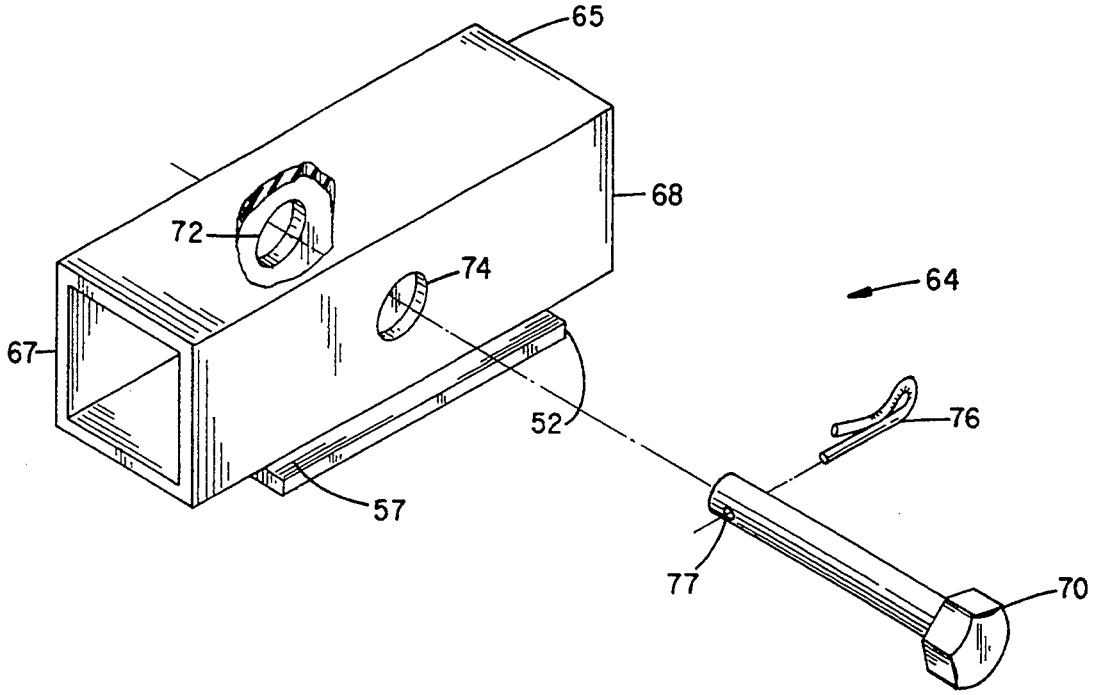
FIG. 4 is a perspective drawing of an alternative spacer and pinned retainer.
Figure 5:
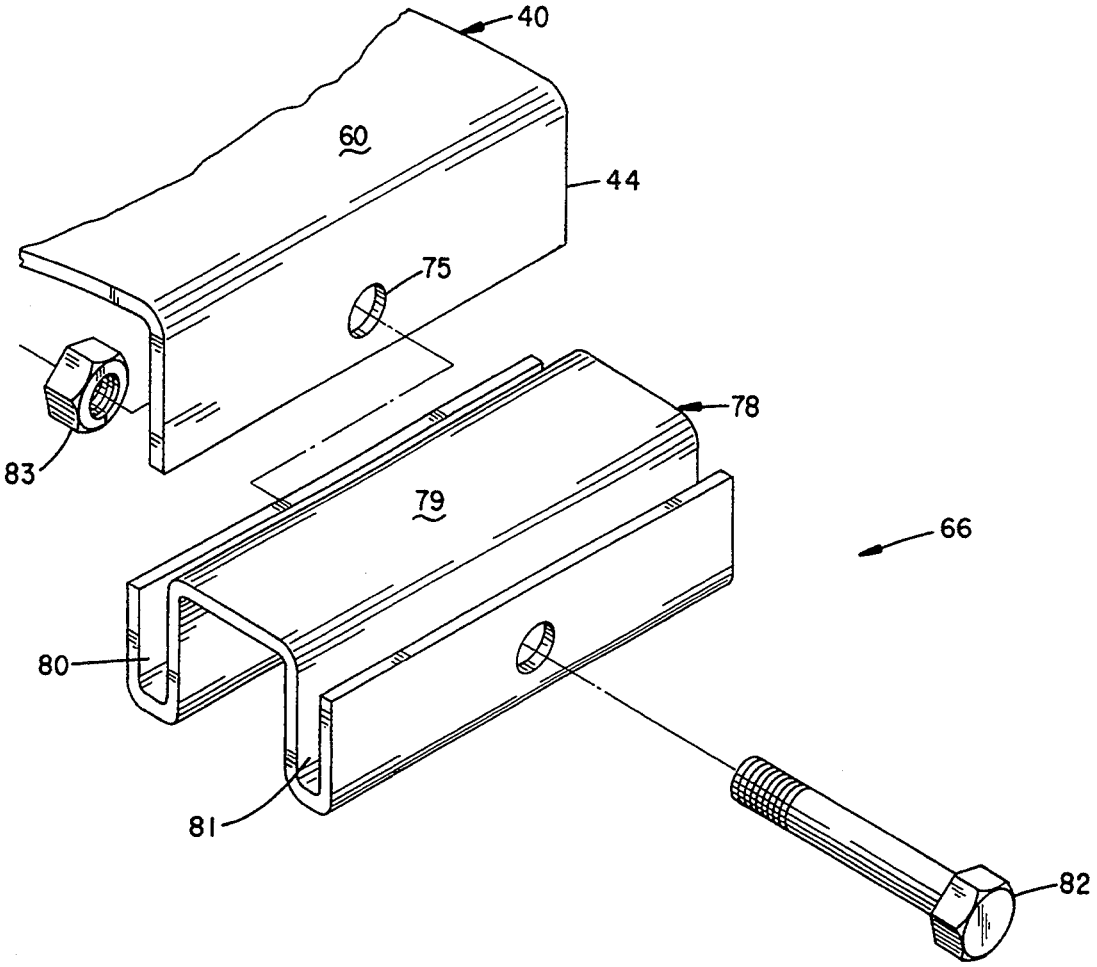
FIG. 5 is a perspective drawing of an alternative drive clip spacer having a threaded nut/ball retainer.

FIGS. 4 and 5 depict alternative spacer/retainer assemblies 64 and 66. FIG. 4 particularly discloses a spacer 65 which can be pin coupled to the tangs 44, 46 to prevent the tangs 44, 46 from spreading apart, once the spacer 65 is positioned. Upon applying a compressive force to draw the tangs 44 and 46 against the vertical sidewalls 67, 68 of the clip 65, a pin 70 is inserted through apertures 72, 74, which align with apertures 75 in the tangs, reference FIG. 5. A separate pin or clip 76 is inserted through a hole 77 in the pin 70 and the spacer 65 is secured to the band 40. A through bolt and nut may alternatively be mounted through the holes 72, 74 to retain the spacer 75 to the band 40.

FIG. 5 depicts another spacer or drive clip 78 which can be constructed of an extruded material or may be stamp formed. The clip 78 includes a surface 79 which aligns with the band surface 60 to form a continuous contour. Vertical channels 80, 81 are formed to either side of the clip 78 to receive and prevent the tang ends 44, 46 from spreading apart once captured in the channels 80, 81. A threaded belt/nut fastener 82, 83 is secured through the tang ends 44, 46 and clip 78 to prevent release from each other.

In normal use of the clip 78, the tang ends 44, 46 are grasped and partially drawn together with a pliers 62 to the point where the channels 80, 81 mount to the tang ends 44, 46. Once partially positioned, the clip 78 is brought into final alignment with the aid of a hammer. During release of the band 40, a hammer and/or screwdriver can be used to release the clip 78 from the band 40 and hole 20.

Appreciating the simplicity of the construction and use of a compressible band, attention is directed to FIG. 6 where a pair of hole former assemblies 84, 86 are shown in relation to a cast manhole 22. The bands 90, 92 of the assemblies 84, 86 are cut to mate in the mold cavity space with the inner and outer surfaces of casting forms (not shown). Circular holes 91, 93 are thereby cast into the cylindrical cast wall 94 of the manhole 22.

As with the hole former 2, the formers 84, 86 are cut in conventional fashion and formed to provide the depicted contoured shapes. Tanged ends 97, 99 and 96, 98 are respectively provided at each band 90, 92 to receive an appropriate spacer and retainer assembly 85, 87, which assemblies 85, 87 may be constructed as described above.

The complex, contoured shapes of the bands 90, 92 are cut from suitable flat stock with the aid of templates that are pre-formed to provide defined hole diameters and accommodate defined cast wall thicknesses. A variety of other custom shapes and thicknesses may be equally formed. For example, triangular, octagonal or rectangular holes may be formed upon bending or roll forming a band member to the desired shape.

FIG. 7 depicts a square hole former 42 such as might be used in conjunction with a cylindrical cast man hole assembly 26. The flat walls of the hole former 100 are defined by appropriately positioned corner bends 100 in the band 102. End tangs 103, 105 are secured to a spacer 101 via a retainer assembly (not shown).

Depending upon the size of former 42 required, the walls 104, 106, 108 and 110 can be formed as a unitary assembly or in appropriate sectional subcombinations of walls. As required, the flat or bent sections can be linked or secured to one another, such as with corner hinges, to produce the desired shape. Although a square former 42 is shown, a variety of other geometric shapes and contours can be accommodated.

While the invention has been described with respect to various presently preferred constructions, it is to be appreciated still other constructions may suggest themselves to those skilled in the art. The following claims should therefore be interpreted to include all those equivalent embodiments within the spirit and scope thereof.

What is claimed is:

1. Mold core apparatus comprising:

a) a band having a molding surface, first and second ends having first and second flanges which project transverse to said molding surface, and first and second contoured longitudinal edges;

b) a tubular spacer;

c) means for retaining said spacer to align said first and second flanges to first and second surfaces of said spacer and a third surface of said spacer in coplanar alignment with said molding surface to define a contoured revolution at said molding surface and configure said first and second edges to complement first and second wall surfaces of first and second spaced molding forms; and d) means for supporting the band between first and second molding form walls to engage said first and second edges thereto, whereby upon depositing a slurry of settable material between said first and second walls and allowing said material to set an opening of contoured revolution is formed through the wall of the molded structure.

2. Apparatus as set forth in claim 1 including tether means for securing said spacer to one of said first and second ends.

3. Apparatus as set forth in claim 1 wherein said spacer includes stop means for aligning said first and second flanges to the spacer and thereby the third surface to the molding surface.

4. Apparatus as set forth in claim 3 wherein said flanges and said spacer each include apertures which align to receive a pin retainer.

5. Apparatus as set forth in claim 4 wherein said first and second surfaces and said first and second flanges exhibit the same width and wherein said stop means comprises a plate secured to said spacer to project orthogonal to said first and second surfaces.

6. Apparatus as set forth in claim 5 including means for tethering said spacer to one of said first and second ends.

7. Apparatus as set forth in claim 1 wherein said band when retained to said spacer exhibits a molding surface of circular revolution and wherein said first and second wall surfaces are arcuate.

8. Apparatus as set forth in claim 1 wherein said band exhibits a molding surface of rectilinear revolution.

9. Apparatus as set forth in claim 8 wherein said first and second wall surfaces are arcuate.

10. Apparatus as set forth in claim 1 wherein said retaining means comprises clamp means having first and second pivoting jaws for drawing said first and second flanges to said spacer and compressively retaining the flanges and for releasing said jaws once the slurry has set a pliers.

11. Apparatus as set forth in claim 4 wherein said pin retainer comprises a threaded bolt and nut.

12. Mold core apparatus comprising:

a) a band having a molding surface, first and second ends having first and second flanges which project transverse to said molding surface and first and second contoured longitudinal edges;

b) a tubular spacer having first and second surfaces which mate to said first and second flanges, stop means engaging said first and second flanges for aligning a third surface of said spacer in coplanar alignment with said molding surface, and tether means for securing said spacer to one of said first and second ends;

c) means for retaining said spacer to said first and second flanges to define a contoured revolution at said molding surface and configure said first and second edges to complement first and second wall surfaces of first and second spaced molding forms, wherein a pin retainer mounts to aligned apertures at each of said first and second flanges and spacer; and d) means for supporting the band between first and second molding form walls to engage said first and second edges thereto, whereby upon depositing a slurry of settable material between said first and second walls and allowing said material to set an opening of contoured revolution is formed through the wall of the molded structure.

* * * * *